US006070439A

United States Patent [19]

Jung

[11] Patent Number: 6,070,439

[45] Date of Patent: Jun. 6, 2000

[54] PULSATOR ASSEMBLY FOR USE IN A WASHING MACHINE FOR FORMING WATER FLOW SPOUTING UPWARD

[75] Inventor: Byung-don Jung, Suwon, Rep. of Korea

[73] Assignee: Samsung Electronics Co., Ltd., Suwon, Rep. of Korea

[21] Appl. No.: 09/158,508

[22] Filed: Sep. 23, 1998

[30] Foreign Application Priority Data

Jul. 8, 1998 [KR] Rep. of Korea ..... P98-27505

[51] Int. Cl.[7] ..... D06F 17/10

[52] U.S. Cl. ..... 68/53; 68/134

[58] Field of Search ..... 68/53, 134

[56] References Cited

U.S. PATENT DOCUMENTS

| | | | |
|---|---|---|---|
| 2,722,118 | 11/1955 | Guthrie | 68/134 |
| 4,420,952 | 12/1983 | Brenner et al. | 68/53 |
| 5,829,276 | 11/1998 | Suh et al. | 68/53 |
| 5,906,116 | 5/1999 | Kim et al. | 68/134 X |
| 5,906,117 | 5/1999 | Kim et al. | 68/134 X |
| 5,906,118 | 5/1999 | Cho et al. | 68/134 X |

FOREIGN PATENT DOCUMENTS

| | | |
|---|---|---|
| 63-30980 | 2/1988 | Japan . |
| 5-131079 | 5/1993 | Japan . |
| 2690479 | 8/1997 | Japan . |

*Primary Examiner*—Philip R. Coe
*Attorney, Agent, or Firm*—Burns, Doane, Swecker & Mathis, L.L.P.

[57] ABSTRACT

Disclosed is a pulsator assembly used in a washing machine. The pulsator assembly comprises of disc-shaped lower pulsator and upper pulsator. A spouting port is formed at a central part of the upper pulsator, and an inflow port is formed at the lower pulsator. A guide rib is provided at an inner space of the pulsator assembly. The guide rib is extended from an area adjacent to a rotational axis to an area adjacent to a circumference. The guide rib is bent against a radial direction. The washing water in the inner space is guided toward the spouting port while a driving motor operates, so as to spout upward through the spouting port. Thus, a spouting water flow is formed along with a vortex water flow, which creates a complex water flow in a washing tub. Accordingly, the laundry is not twisted and the laundry is effectively washed and rinsed.

9 Claims, 6 Drawing Sheets

PULSATOR ASSEMBLY FOR USE IN A WASHING MACHINE FOR FORMING WATER FLOW SPOUTING UPWARD

BACKGROUND OF THE INVENTION

1. Field of the Invention

The present invention relates to a pulsator assembly for use in a washing machine, and more particularly, to a pulsator assembly capable of improving washing efficiency by generating water flow spouting upward in a washing tub.

2. Prior Art

A general washing machine for washing and dehydrating laundry has, as shown in FIG. 1, an outer tub 2 installed in a casing 1, a washing tub 6 installed in the outer tub 2 so as to accommodate laundry, a pulsator 8 installed at the bottom of the washing tub 6, a driving motor 3 installed under the outer tub 2, and a gear assembly 5 for transmitting the power of the driving motor 3 to the pulsator 8 and the washing tub 6 selectively.

Ducts 11 are formed in the inner wall of the washing tub 6. The ducts 11 form vertical water passages in the inner wall. A discharge opening is formed at the upper end of the duct 11, and an inflow opening is formed at the lower end of the duct 11. The washing water in the washing tub 6 flows into the duct 11 through the inflow opening and is discharged from the duct 11 through the discharge opening. A filter 13 for filtering dirt in the washing water is attached to the discharge opening. A plurality of holes 6*a* are formed at the side wall of the washing tub 6. The outer tub 2 and the washing tub 6 communicate with each other through the holes 6*a*.

The pulsator 8 has, as shown in FIG. 2, a disc-shaped body 8*a*. A plurality of agitating wings 8*b* are radially disposed at the upper surface of the body 8*a*, and a plurality of blades 8*c* are radially disposed at the lower surface thereof. The blades 8*c* are positioned near the inflow opening of the duct 11.

During the washing operation, the power of the driving motor 3 is transmitted to the pulsator 8 through the gear assembly 5. Then, the pulsator 8 is rotated so as to generate vortex water flow in the washing tub 6. The pulsator 8 is bilaterally rotated by the turning of the driving motor 3. The laundry accommodated in the washing tub 6 is washed by the vortex water flow generated by the pulsator 8. The agitating wings 8*b* help the operation of the pulsator 8 for generating the vortex water flow.

When the pulsator 8 rotates, the washing water flows into the ducts 11 via the blades 8*c*. The washing water flowing into the duct 11 moves upward, and is discharged through the discharge opening. The dirt contained in the washing water is filtered by the filter 13, and the filtered washing water is re-supplied to the washing tub 6.

As described, the laundry is washed by the vortex water flow generated by the pulsator 8 and by the circulating water flow generated by the ducts 11.

During the dehydrating operation, the power of the driving motor 3 is transmitted to the washing tub 6 and the pulsator 8 simultaneously through the gear assembly 5, whereby the washing tub 6 and the pulsator 8 are rotated together with a high rotational speed. Dehydration is performed by the centrifugal force generated in such a situation.

However, in such a conventional washing machine, sufficient washing efficiency cannot be achieved since only a simple vortex water flow is generated by the pulsator 8. Furthermore, due to such simple vortex water flow, laundry may be twisted. If the laundry is twisted, washing efficiency is lowered, detergent is not throughly cleaned during a rinsing operation, and the laundry itself may be damaged.

SUMMARY OF THE INVENTION

The present invention has been proposed to overcome the above described problems in the prior art, and accordingly it is an object of the present invention to provide a pulsator for use in a washing machine, which is capable of generating a complex water flow so that twisting and damage of the laundry are prevented and washing efficiency is improved.

To achieve the above object, the present invention provides a pulsator assembly for use in a washing machine, the pulsator assembly being rotated by a driving motor so as to generate water flow in a washing tub, the pulsator assembly comprising: a disc-shaped lower pulsator being installed at a bottom of the washing tub; an upper pulsator being assembled with the lower pulsator, the upper pulsator being formed with a spouting port at a central part thereof, and a guide rib being provided in an inner space formed by the upper pulsator and the lower pulsator, the guide rib being extended from an area adjacent to a rotational axis to an area adjacent to a circumference, the guide rib being bent against a radial direction. The washing water in the inner space is guided toward the spouting port while the driving motor operates, so as to spout upward through the spouting port. A plurality of agitating wings are provided at the upper surface of the upper pulsator. The spouting water flow is generated together with a vortex water flow generated by the agitating wings.

It is possible that a plurality of guide ribs are provided, and preferably a pair of guide ribs are provided. In such a situation, the guide ribs are preferably disposed at positions opposite to each other about the rotational axis so as to form an S-shape substantially. Furthermore, the guide ribs are formed in a body with the upper pulsator.

At the lower pulsator, at least one inflow port is formed through which the washing water flows into the inner space. An edge of the inflow port is tilted. The tilted side functions to guide the washing water into the inner space.

According to the present invention, the spouting water flow is formed along with the vortex water flow, which creates a complex water flow in the washing tub. Accordingly, the laundry is not twisted, no damage on the laundry occurs, and the laundry is effectively rinsed.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
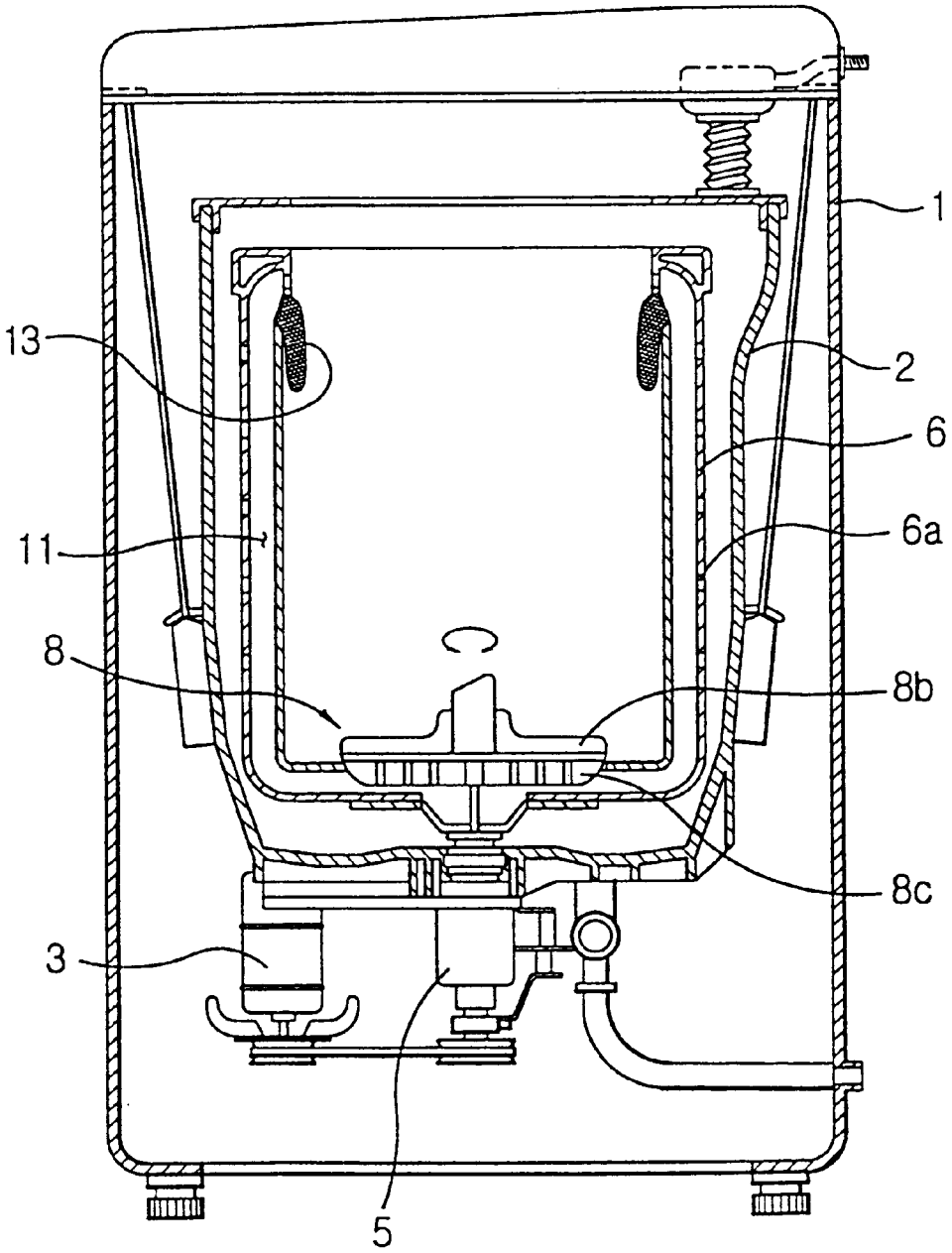
FIG. 1 (PRIOR ART)
FIG. 1 is a side sectional view of a conventional washing machine.
Figure 2:
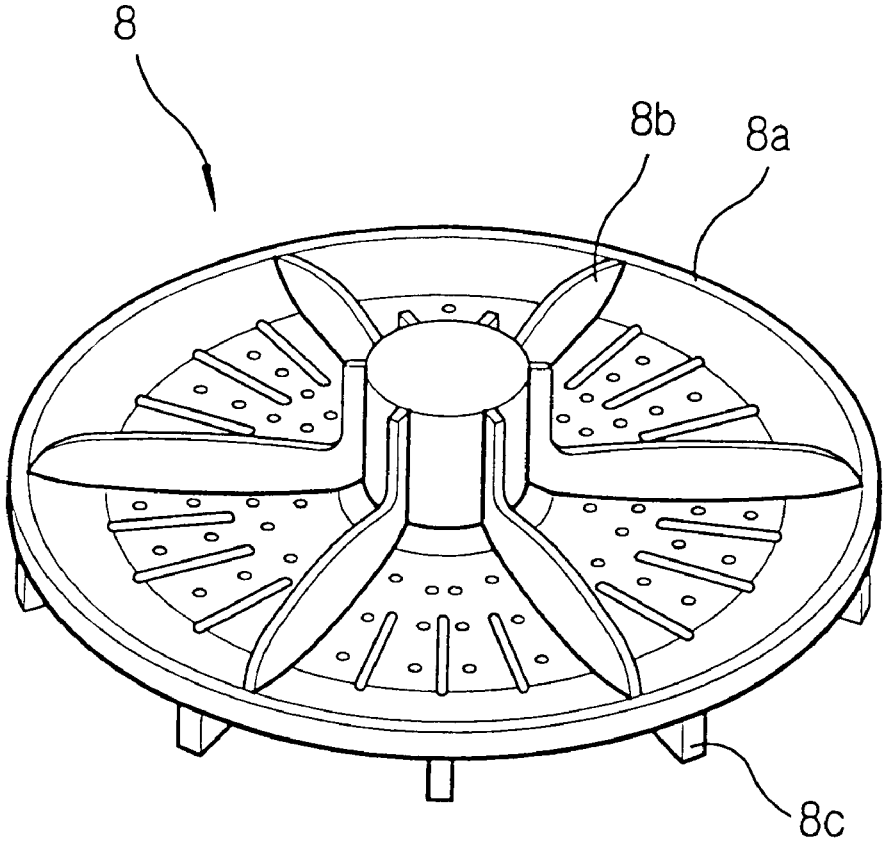
FIG. 2 (PRIOR ART)
FIG. 2 is a perspective view of a conventional pulsator.

Hereinafter, the present invention will be described in detail with reference to the drawings. The same parts with the parts of the conventional washing machine will not be described, and will be referred to with the same reference numerals.

Figure 3:
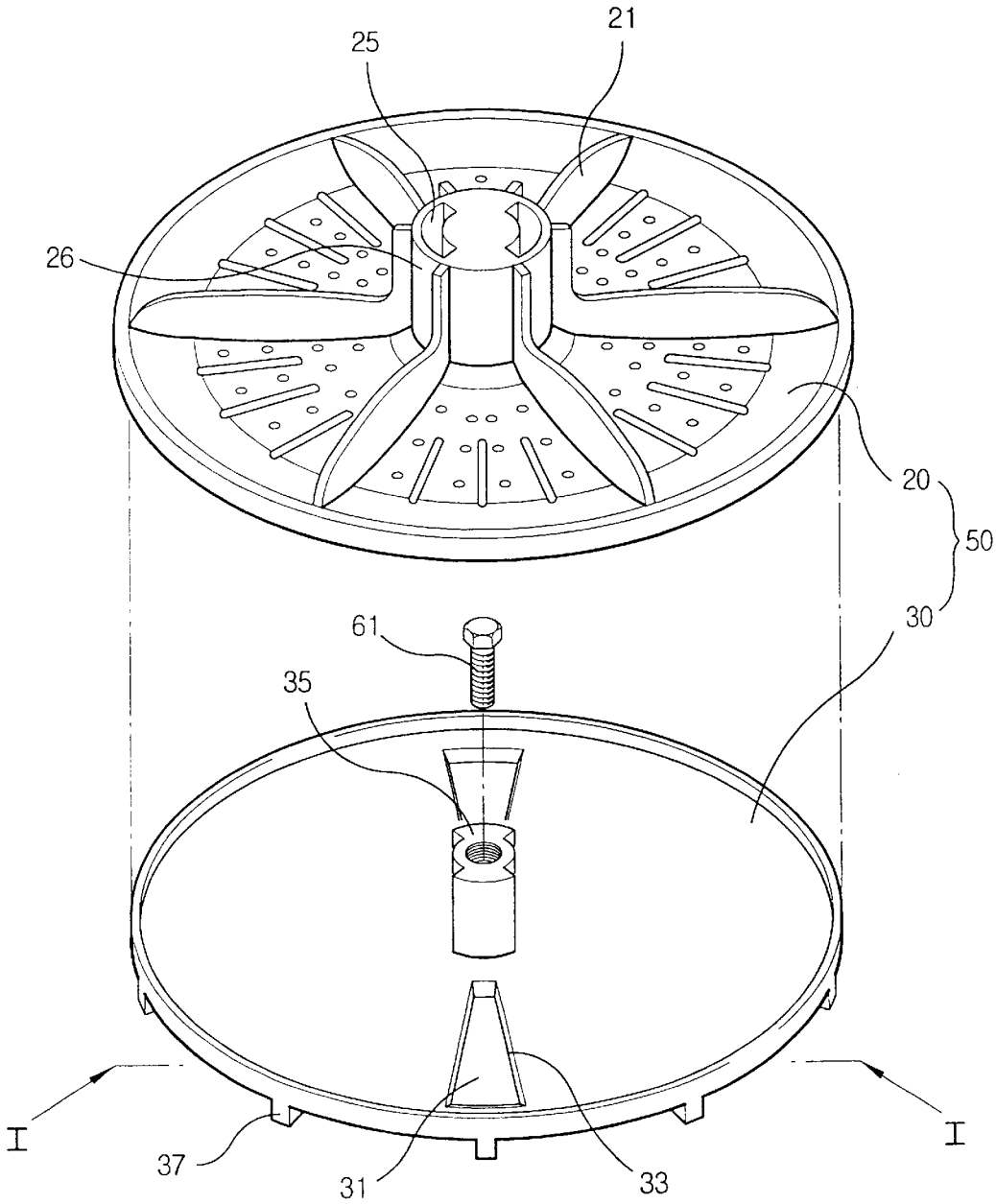
FIG. 3 is an exploded perspective view of a pulsator assembly according to the present invention.
Figure 4:
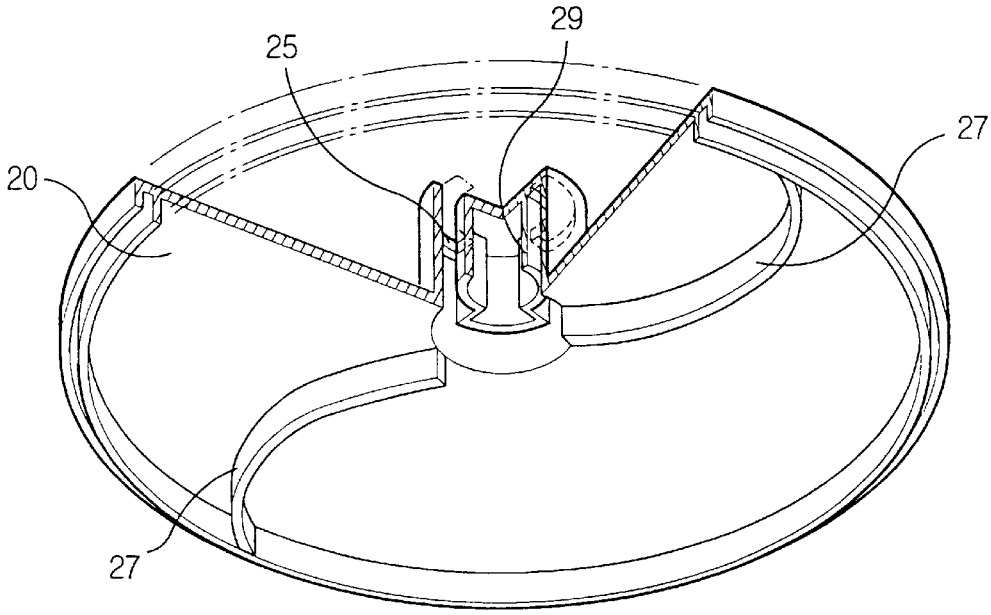
FIG. 4 is a perspective view showing the bottom side of the upper pulsator shown in FIG. 3.
Figure 5:
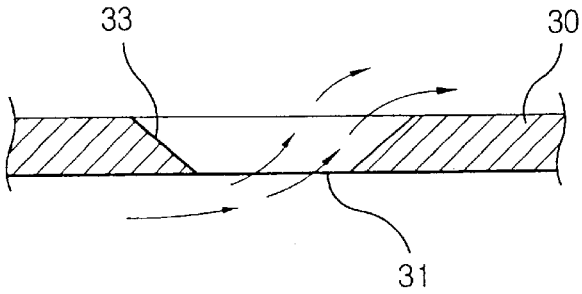
FIG. 5 is a partial side sectional view of FIG. 3 taken along the line I—I.

FIGS. 3 through 5 show a pulsator assembly according to the present invention. The pulsator assembly 50 is comprised of an upper pulsator 20 and a lower pulsator 30 which are disc-shaped. The lower pulsator 30 is installed at the bottom of the washing tub 6, and the upper pulsator 20 is assembled with the lower pulsator 30. As the upper pulsator 20 and the lower pulsator 30 are assembled with each other, a predetermined inner space is formed in the pulsator assembly 50.

A spouting part 26 protrudes from the central part of the upper pulsator 20, and a pair of spouting ports 25 are formed at the spouting part 26. A plurality of agitating wings 21 are formed radially at the upper surface of the upper pulsator 20.

An assembly part 35 is provided at the central part of the lower pulsator 30. The assembly part 35 is fixed to a pulsator shaft of the gear assembly 5 by a bolt 61. Another assembly part 29 which corresponds to the assembly part 35 of the lower pulsator 30 is provided at the inner area the spouting part 26. The assembly part 29 of the upper pulsator 20 and the assembly part 35 of the lower pulsator 30 are assembled with each other, by which the upper and lower pulsators 20 and 30 are fixed to each other in a rotational direction. Therefore, the lower pulsator 30 and the upper pulsator 20 are rotated together by the driving motor 3.

The lower pulsator 30 is formed with a pair of inflow ports 31 disposed at positions opposite to each other about the rotational axis thereof. The inflow ports 31 provide passages for the washing water to flow into the inner space of the pulsator assembly 50. At the edge of the inflow port 31 is formed a tilted side 33 as shown in FIG. 5. The tilted side 33 functions to guide the washing water so that the washing water flows into the pulsator assembly 50 while the pulsator assembly 50 is rotating.

A plurality of blades 37 are formed at the lower surface of the lower pulsator 30 radially. The blades 37 are positioned near the inflow openings of the ducts 11.

A pair of guide ribs 27 are provided in the inner space of the pulsator assembly 50. The guide ribs 27 are formed together with the upper pulsator 20, and are disposed at positions opposite to each other about the rotational axis. The guide ribs 27 are extended from an area adjacent to the rotational axis of the pulsator assembly 50 to an area adjacent to the circumference thereof, and are bent clockwise. Therefore, the pair of guide ribs 27 form an S-shape substantially.

Hereinbelow, the operation and effect of the pulsator assembly 50 according to the present invention having the above-described constitution will be described with reference to FIGS. 6 and 7.

Figure 6:
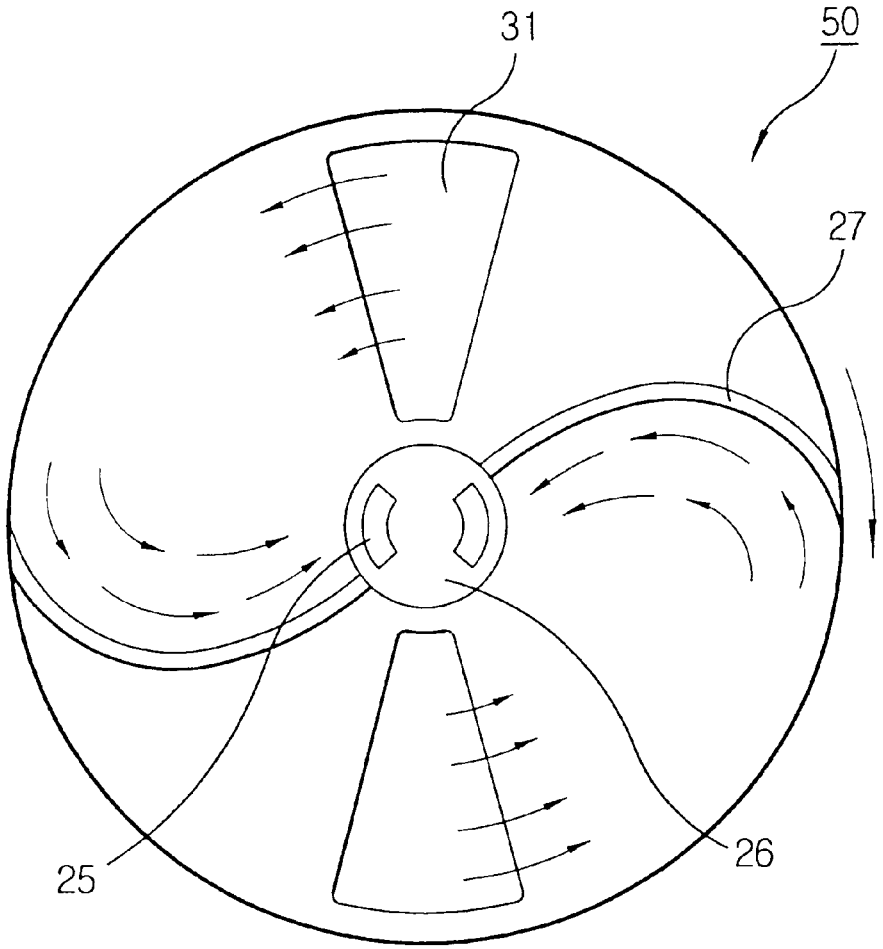
FIG. 6 is a view for showing the operation of the pulsator assembly shown in FIG. 3.
Figure 7:
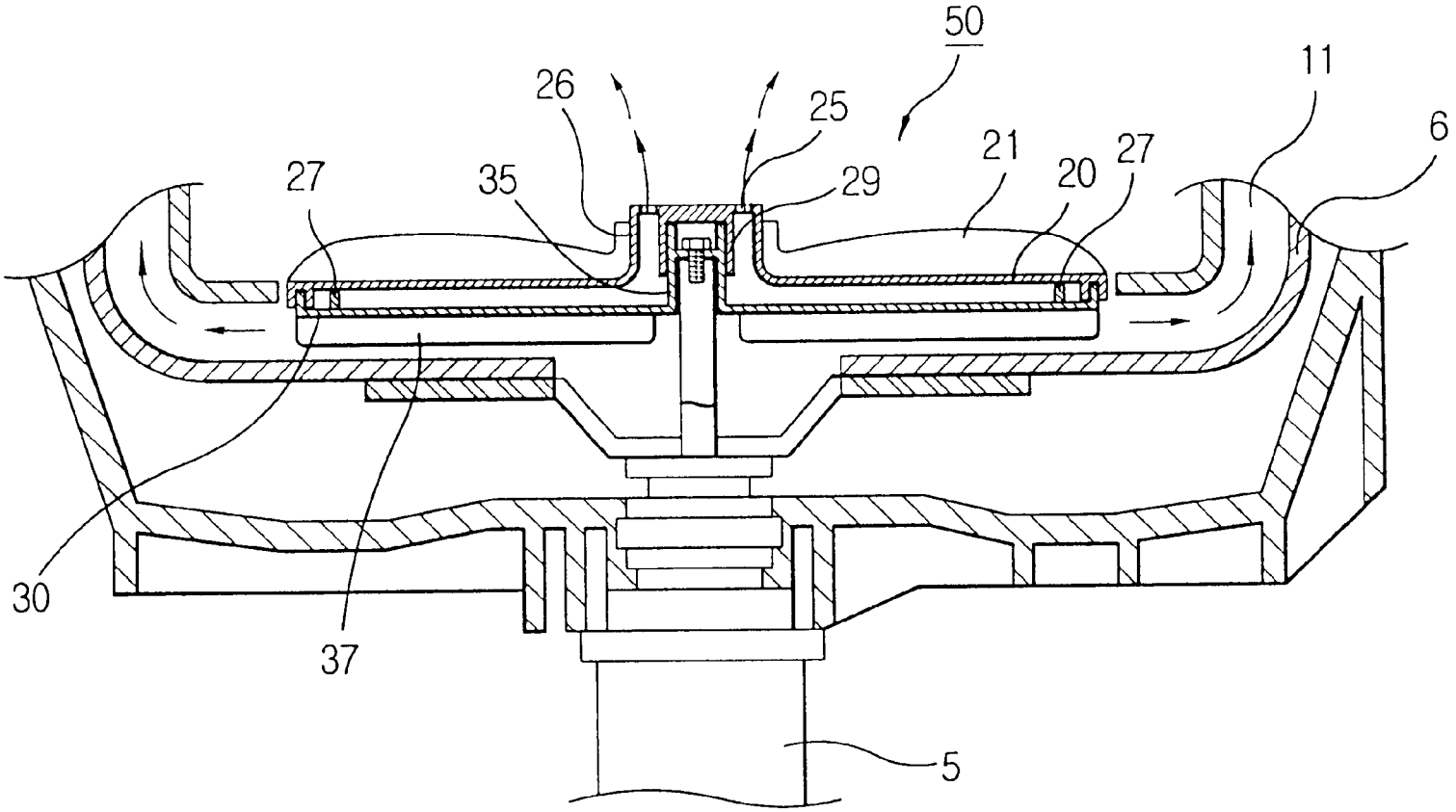
FIG. 7 is a partial enlarged side sectional view of a washing machine adopting the pulsator assembly shown in FIG. 3.

As the pulsator 50 assembly rotates in clockwise direction as shown in FIG. 6, the washing water in the inner space thereof moves toward the guide ribs 27 relatively. The washing water striking upon the guide ribs 27 is guided to the spouting part 26 of the pulsator assembly 50, and then spouts upward through the spouting ports 25. Therefore, a spouting water flow is formed as shown in FIG. 7 along with the vortex water flow formed by the agitating wings 21, whereby a complex water flow is created in the washing tub 6.

Meanwhile, the blades 37 give centrifugal force to the washing water while the pulsator assembly 50 is rotating, whereby a radial water flow is generated. As shown in FIG. 7, the washing water flows into the ducts 11 by the radial water flow, and then the washing water is discharged through the discharge openings formed at the upper part of the ducts 11. Then, the washing water is filtered by the filter 13.

As the pulsator assemble 50 rotates in counterclockwise direction, the operation of the guide ribs 27 and the spouting port 25 for spouting the washing water is stopped. Thus, as the pulsator assembly 50 repeats rotating in forward and reverse directions, the washing water is spouted upwardly in an intermittent manner, along with the vortex water flow. Therefore, a complex water flow is generated in the washing tub 6, whereby the laundry is less twisted and the washing efficiency is improved.

In the present embodiment, the example is shown in which a pair of guide ribs 27 are disposed in an S-shape substantially, however, the number of guide ribs 27 and positions thereof can be changed according to different situations. For example, it is possible that only one single guide rib is provided, or a number of guide ribs are radially disposed. Furthermore, the guide ribs 27 in the present embodiment are formed in a body with the upper pulsator 20, however, they can be formed in a body with the lower pulsator 30 or manufactured separately to be fixed on the upper pulsator 20 or the lower pulsator 30.

Moreover, the shape, number, and position of the inflow ports 31 can also be changed. That is, the inflow ports 31 can be formed at the upper pulsator 20, and a number of inflow ports 31 can be provided. In such a situation, it is preferable that the number of the inflow ports 31 corresponds to the number of guide ribs 27.

As described above, according to the present invention, the spouting water flow is formed along with the vortex water flow, which creates a complex water flow in the washing tub. Accordingly, the laundry is not twisted, no damage to the laundry occurs, and the laundry is effectively rinsed.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A pulsator assembly for use in a washing machine, said pulsator assembly being rotated about a rotational axis by a driving motor so as to generate water flow in a washing tub, said pulsator assembly comprising:

a disc-shaped lower pulsator being installed at a bottom of said washing tub;

an upper pulsator being assembled with said lower pulsator, said upper pulsator being formed with a spouting port at a central part thereof; and a guide rib being provided in an inner space formed by said upper pulsator and said lower pulsator, said guide rib being extended from an area adjacent to the rotational axis to an area adjacent to an outer circumference of the space, said guide rib being bent against a radial direction, whereby washing water in the inner space is guided toward said spouting port while said driving motor operates, so as to spout upward through the spouting port.

2. The pulsator assembly as claimed in claim 1, wherein a plurality of said guide ribs are provided.

3. The pulsator assembly as claimed in claim 2, wherein a pair of said guide ribs are disposed at positions opposite to each other about the rotational axis so as to form an S-shape substantially.

4. The pulsator assembly as claimed in claim 1, wherein said guide rib is formed in a body with said upper pulsator.

5. The pulsator assembly as claimed in claim 1, wherein at least one inflow port is formed through which the washing water flows into the inner space.

6. The pulsator assembly as claimed in claim 5, wherein the inflow port is formed at said lower pulsator.

7. The pulsator assembly as claimed in claim 5, wherein an edge of the inflow port is tilted so that the washing water is guided into the inner space.

8. The pulsator assembly as claimed in claim 1, further comprising a plurality of blades formed radially at a lower surface of said lower pulsator.

9. The pulsator assembly as claimed in claim 1, further comprising a plurality of agitating wings formed at an upper surface of said upper pulsator.

* * * * *